US007347673B2

(12) United States Patent
Yamanouchi et al.

(10) Patent No.: US 7,347,673 B2
(45) Date of Patent: Mar. 25, 2008

(54) FLUID MACHINE SERVED AS EXPANSION DEVICE AND COMPRESSION DEVICE

(75) Inventors: Akihito Yamanouchi, Kariya (JP); Masahiro Kawaguchi, Kariya (JP); Masao Iguchi, Kariya (JP); Xiaoliang Wang, Kariya (JP); Satoshi Umemura, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 730 days.

(21) Appl. No.: 10/889,394

(22) Filed: Jul. 12, 2004

(65) Prior Publication Data

US 2005/0013701 A1 Jan. 20, 2005

(30) Foreign Application Priority Data

Jul. 14, 2003 (JP) ..... 2003-196833

(51) Int. Cl.
*F04B 7/00* (2006.01)

(52) U.S. Cl. ..... 417/237; 417/446

(58) Field of Classification Search ..... 417/237, 417/446, 447, 505

See application file for complete search history.

(56) References Cited

U.S. PATENT DOCUMENTS 457,762 A * 8/1891 Dittmar et al. ..... 417/505
1,080,063 A * 12/1913 Hill ..... 417/237
2,785,638 A * 3/1957 Moller ..... 417/505
2004/0184923 A1 9/2004 Iwanami et al.

FOREIGN PATENT DOCUMENTS

| | | |
|---|---|---|
| DE | 2928169 A1 | 1/1981 |
| JP | 63-96449 | 4/1988 |
| JP | 05-296163 | 11/1993 |
| JP | 06-159013 | 6/1994 |
| JP | 06-159015 | 6/1994 |
| JP | 06159013 A | 6/1994 |
| JP | 10-054379 | 2/1998 |
| JP | 11-093876 | 4/1999 |
| JP | 2000-149972 | 5/2000 |

* cited by examiner

*Primary Examiner*—Michael Koczo, Jr.
(74) *Attorney, Agent, or Firm*—Knoble, Yoshida & Dunleavy, LLC

(57) ABSTRACT

A fluid machine is served as an expansion device and a compression device. The fluid machine compresses gas in an operation chamber upon functioning as the compression device. The fluid machine expands the gas in the operation chamber upon functioning as the expansion device. The fluid machine includes a movable discharge valve served as a differential pressure regulating valve that discharges the gas from the operation chamber when the fluid machine functions as the compression device. The discharge valve is moved to a non-operation position where the discharge valve fails to function as the differential pressure regulating valve when the fluid machine functions as the expansion device.

9 Claims, 5 Drawing Sheets

FLUID MACHINE SERVED AS EXPANSION DEVICE AND COMPRESSION DEVICE

BACKGROUND OF THE INVENTION

The present invention relates to a fluid machine served as an expansion device and a compression device.

It has been proposed that a refrigerant compression device in an air-conditioning cycle is utilized as an expansion device to perform a Rankine cycle (refer to Japanese Unexamined Patent Publication No. 6-159013). The structure of a fluid machine served as an expansion device and a compression device is not described in detail in Japanese Unexamined Patent Publication No. 6-159013. However, it is easy to assume that a scroll type fluid machine disclosed in Japanese Unexamined Patent Publication No. 5-296163 can be utilized as the fluid machine served as the expansion device and the compression device.

When the above scroll type fluid machine functions as the compression device, an operation chamber defined by movable and fixed scroll members is moved from an outer peripheral side to a central side while reducing in volume by the orbital movement of the movable scroll member relative to the fixed scroll member. Thus, refrigerant gas is compressed in the operation chamber. The high pressure refrigerant gas in the operation chamber at the central side is discharged to the high pressure chamber via a port formed in the fixed scroll member and then flows out from the high pressure chamber to an external circuit.

When the above scroll type fluid machine functions as the expansion device, the high-pressure refrigerant gas introduced from the external circuit into the high pressure chamber is introduced into the operation chamber at the central side via the port. Then, the operation chamber at the central side is moved to the outer peripheral side while increasing in volume by expansion of the refrigerant gas. Thus, the movable scroll member orbits relative to the fixed scroll members so that driving power is generated.

When the above scroll type fluid machine functions either as the compression device and the expansion device, the refrigerant gas flows between the operation chamber at the central side and the high pressure chamber via the common port.

The port regularly communicates with the high pressure chamber in the above fluid machine. Thus, when the above fluid machine functions as the compression device, at the timing when the compressed refrigerant gas in the operation chamber at the central side is discharged into the high pressure chamber, the operation chamber communicates with the port. Namely, the timing is always constant.

However, an appropriate timing when the refrigerant gas in the operation chamber at the central side is discharged into the high pressure chamber varies in accordance with an operational state of the compression device such as a rotational speed (an orbital speed of the movable scroll member) and suction pressure. Thus, in the structure in which the compressed refrigerant gas is discharged from the operation chamber into the high pressure chamber at the constant timing, the refrigerant gas is not compressed to a predetermined pressure when the suction pressure is low. Therefore, there arises a problem that the refrigerant gas flows back from the high pressure chamber to the operation chamber and efficiency is lowered.

To solve such problem, a discharge valve is provided for opening and closing the port in the fluid machine that functions only as the compression device. The discharge valve is served as a differential pressure regulating valve (e.g. a reed valve) that opens and closes the port in accordance with the pressure difference between the pressure in the operation chamber acting in the direction to open the port and the pressure in the high pressure chamber acting in the direction to close the port.

However, when the discharge valve served as the differential pressure regulating valve is utilized in the fluid machine served as the compression device and the expansion device, the discharge valve blocks the flow of the refrigerant gas from the high pressure chamber to the operation chamber upon functioning as the expansion device. Thus, there arises a problem that the fluid machine actually does not function as the expansion device. Also, there similarly arises such problem in other type machines such as vane type and piston type machines in addition to the scroll type machine.

SUMMARY OF THE INVENTION

The present invention provides a fluid machine served as an expansion device and a compression device, which discharges compressed gas from an operation chamber to a high pressure chamber at appropriate timing upon functioning as the compression device.

According to the present invention, a fluid machine is served as an expansion device and a compression device. The fluid machine compresses gas in an operation chamber upon functioning as the compression device. The fluid machine expands the gas in the operation chamber upon functioning as the expansion device. The fluid machine includes a movable discharge valve served as a differential pressure regulating valve that discharges the gas from the operation chamber when the fluid machine functions as the compression device. The discharge valve is moved to a non-operation position where the discharge valve fails to function as the differential pressure regulating valve when the fluid machine functions as the expansion device.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe first and second preferred embodiments of the present invention. In the first and second preferred embodiments, the present invention is applied to a fluid machine served as an expansion device and a compression device. In an air-conditioning cycle provided in an air-conditioner of a vehicle, the fluid machine functions as the compression device. In a Rankine cycle for collecting driving power from exhaust heat of an engine (an internal combustion engine), the fluid machine functions as the expansion device.

Figure 1:
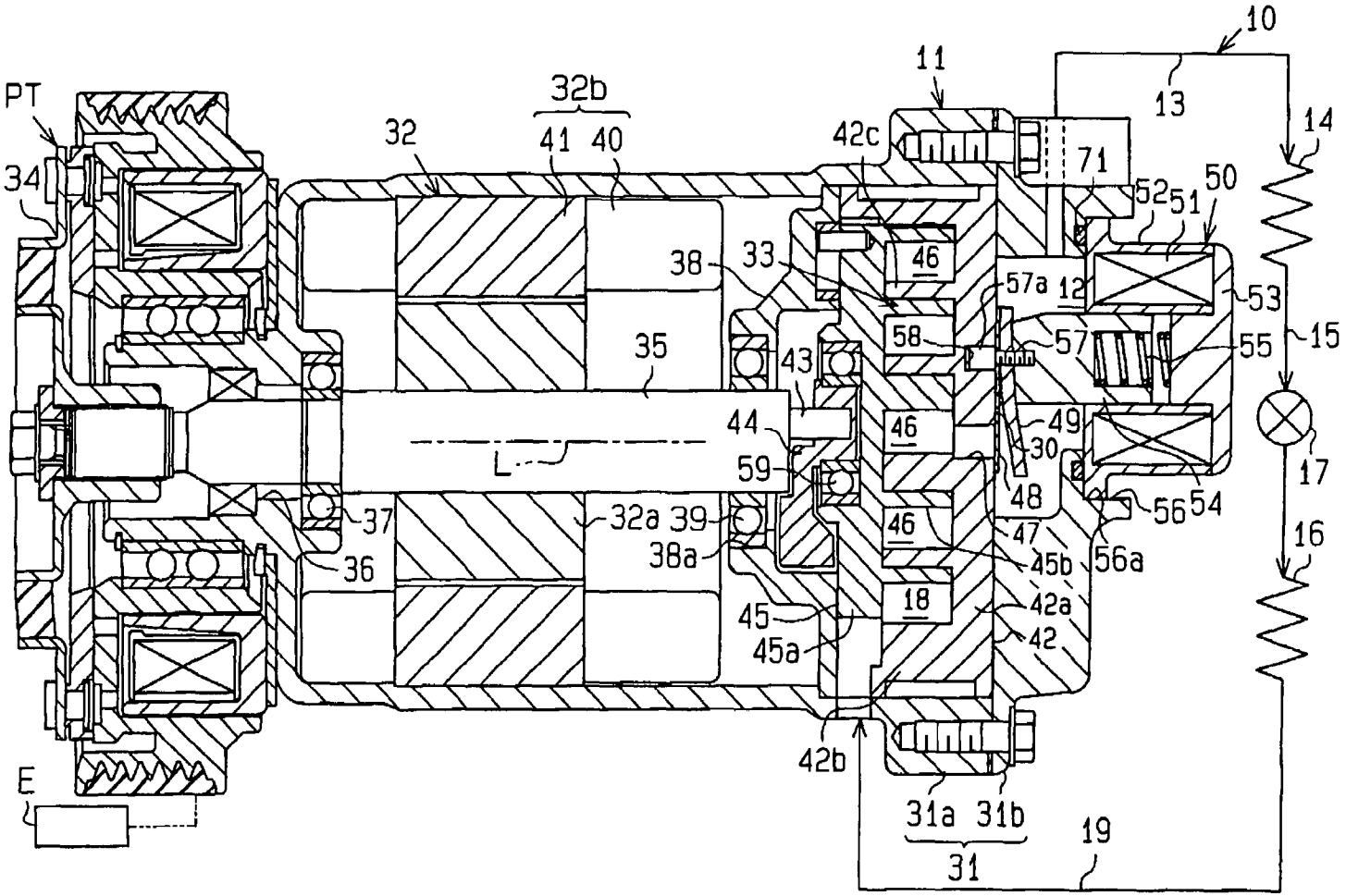
FIG. 1 is a longitudinal cross-sectional view of a fluid machine served as an expansion device and a compression device upon functioning as the compression device according to a first preferred embodiment of the present invention.

Now, the first preferred embodiment will be described with reference to FIGS. 1 and 2. It is noted that the left and right sides of the drawings respectively corresponds to the front and rear sides of a fluid machine 11 served as an expansion device and a compression device in FIGS. 1 and 2. As shown in FIG. 1, a vapor compression type air-conditioning cycle 10 includes the fluid machine 11 that functions as the compression device. The fluid machine 11 includes a high pressure chamber 12 that is connected to the inlet of a cooler 14 via a pipe 13. The cooler 14 is located in the engine room of the vehicle and is exposed to outside air. High pressure refrigerant gas having high temperature flows out from the high pressure chamber 12 of the fluid machine 11 into the cooler 14 via the pipe 13. Then, the refrigerant gas is cooled in the cooler 14 by heat exchange with the outside air so that the refrigerant gas is condensed and liquefied.

The outlet of the cooler 14 is connected to the inlet of an evaporator 16 via a pipe 15. An expansion valve 17 is arranged on the pipe 15 for depressurizing the liquid refrigerant from the cooler 14.

The evaporator 16 is arranged on an air duct (not shown) that extending to the vehicle interior. The liquid refrigerant depressurized at the expansion valve 17 is heated and vaporized at the evaporator 16 by heat exchange with the outside air that goes toward the vehicle interior, thereby turning into the low pressure refrigerant gas. The outlet of the evaporator 16 is connected to a low pressure chamber 18 of the fluid machine 11 via a pipe 19. Thus, the fluid machine 11 sucks the low pressure refrigerant gas introduced from the evaporator 16 into the low pressure chamber 18, compresses it and discharges it into the high pressure chamber 12. The high pressure refrigerant gas flowing out from the high pressure chamber 12 of the fluid machine 11 is sent to the cooler 14, and then the above-described air-conditioning cycle 10 is repeated.

Figure 2:
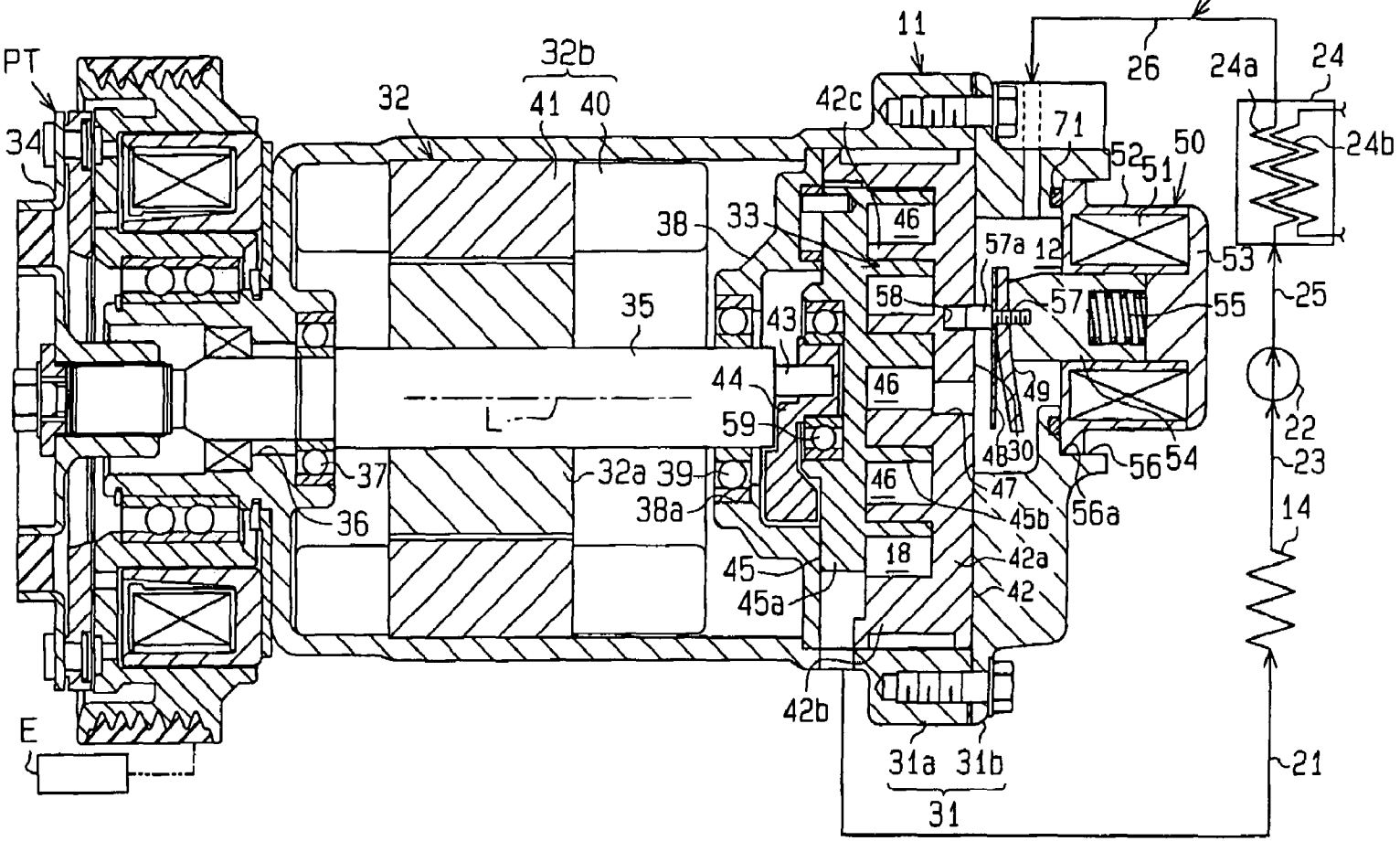
FIG. 2 is a longitudinal cross-sectional view of the fluid machine upon functioning as the expansion device according to the first preferred embodiment of the present invention.

Referring to FIG. 2, a Rankine cycle 20 is performed by utilizing a part of the circuitry of the air-conditioning cycle 10 (refer to FIG. 1) in the vehicle. The Rankine cycle 20 is performed by a certain group of components of the fluid machine 11 that functions as the expansion device. The low pressure chamber 18 of the fluid machine 11 is connected to the inlet of the cooler 14 via a pipe 21. The refrigerant gas that has expanded and has been depressurized flows out from the low pressure chamber 18 of the fluid machine 11 into the cooler 14 via the pipe 14. Then, the refrigerant gas is condensed and liquefied at the cooler 14.

The outlet of the cooler 14 is connected to the inlet of a pump 22 via a pipe 23. The outlet of the pump 22 corresponding to a discharge side is connected to the inlet of a heat sink 24*a* that is provided in a boiler 24 via a pipe 25. The pump 22 pressurizes and sends the liquid refrigerant from the cooler 14 to the heat sink 24*a* of the boiler 24.

Cooling water that is heated by cooling an engine E is sent to a radiator 24*b* of the boiler 24. The liquid refrigerant is heated at the heat sink 24*a* by heat exchange with the heated cooling water, thereby turning into the high pressure refrigerant gas having high temperature. The outlet of the heat sink 24*a* is connected to the high pressure chamber 12 of the fluid machine 11 via a pipe 26. The high pressure refrigerant gas flows from the heat sink 24*a* into the high pressure chamber 12 of the fluid machine 11 via the pipe 26. The fluid machine 11 generates driving power by adiabatic expansion of the high pressure refrigerant gas that flows into the fluid machine 11. The refrigerant gas that has expanded and has been depressurized at the fluid machine 11 is sent from the low pressure chamber 18 to the cooler 14 via the pipe 21. Then, the above-described Rankine cycle 20 is repeated.

As described above, the air-conditioning cycle 10 and the Rankine cycle 20 are performed by the fluid machine 11 and the cooler 14 in the first preferred embodiment. Although not shown, a cycle switching mechanism such as a flow path switching valve, that switches flow path of the refrigerant so as to change between the air-conditioning cycle 10 of FIG. 1 and the Rankine cycle 20 of FIG. 2, is also provided for sharing the fluid machine 11 and the cooler 14. Thus, some of the pipes 13, 15, 19, 21, 23, 25 and 26 each share a part or a whole of the pipe that is referred to by the same or different reference numeral in FIGS. 1 and 2.

Referring back to FIG. 1, the fluid machine 11 includes a motor generator 32 and a compressing and expanding mechanism 33 that are accommodated in a housing 31 of the fluid machine 11. The fluid machine 11 also includes a power transmission mechanism PT that is provided outside the housing 31. The power transmission mechanism PT is arranged on a power transmission path between the engine E as an external driving source and the compressing and expanding mechanism 33. The power transmission mechanism PT includes an electromagnetic clutch 34. When the electromagnetic clutch 34 is switched on, the power transmission mechanism PT transmits driving power from the engine E to the compressing and expanding mechanism 33. On the other hand, when the electromagnetic clutch 34 is switched off, the power transmission mechanism PT blocks the driving power from the engine E to the compressing and expanding mechanism 33.

The compressing and expanding mechanism 33 is a scroll type. When the air-conditioning cycle 10 is performed, the compressing and expanding mechanism 33 functions as a compressing mechanism that sucks the low pressure refrigerant gas from the evaporator 16 and compresses it. When the Rankine cycle 20 (refer to FIG. 2) is performed, the compressing and expanding mechanism 33 functions as an expanding mechanism that generates driving power by expansion of the high pressure refrigerant gas that flows in from the boiler 24. Meanwhile, when the air-conditioning cycle 10 is performed, the motor generator 32 functions as an electric motor that drives the compressing and expanding mechanism 33. When the Rankine cycle 20 is performed, the motor generator 32 functions as a generator that is driven by the compressing and expanding mechanism 33 to generate electric power.

When the air-conditioning cycle 10 is performed, the fluid machine 11 is selectively driven by the driving power from the engine E via the transmission mechanism PT and the driving power from the motor generator 32. Since the motor generator 32 that is capable of functioning as the electric motor is provided in the fluid machine 11, air-conditioning (cooling) is performed even in a stop state of the engine E. Therefore, the air-conditioning cycle 10 of the first preferred embodiment is suitable for an idling stop vehicle and a hybrid vehicle (a vehicle that selectively utilizes the engine E or an electric motor as a driving source for traveling the vehicle) in which the engine E is sometimes and automatically stopped.

When the air-conditioning cycle 10 is formed and the fluid machine 11 is driven only by the motor generator 32, the electromagnetic clutch 34 is switched off. Also, when the Rankine cycle 20 is performed, the electromagnetic clutch 34 is switched off (refer to FIG. 2).

The housing 31 includes a first housing member 31*a* and a second housing member 31*b*. The first housing member 31*a* has a substantially cylindrical shape with a bottom that corresponds to the front side (the left side in FIGS. 1 and 2) of the fluid machine 11. The second housing member 31*b* is fixed to the first housing member 31*a*. A shaft 35 is rotatably arranged in the housing 31. A through hole 36 extends through the center of the rear of the first housing member 31*a*. The front end portion of the shaft 35 is inserted through the through hole 36 and rotatably supported by the housing 31 through a bearing 37 in the through hole 36.

A shaft support member 38 is fixed on the rear end side of the first housing member 31*a* in the housing 31 and has a through hole 38*a* extending through the center of the shaft support member 38. The rear end portion of the shaft 35 is inserted through the through hole 38*a* and rotatably supported by the shaft support member 38 through a bearing 39 in the through hole 38*a*.

A rotor 32*a* of the motor generator 32 is rotatably fixed to the shaft 35 in the housing 31. A stator 32*b* constituting the motor generator 32 is fixedly arranged on the inner peripheral surface of the housing 31 so as to surround the rotor 32*a*. The stator 32*b* includes a stator core 41 and a coil 40 wound around the stator core 41. The motor generator 32 functions as the electric motor that rotates the rotor 32*a* by supplying electric power to the coil 40 and as the generator that generates the electric power at the coil 40 by rotatably driving the rotor 32*a*.

A fixed scroll member 42 is fixedly accommodated at the opening end portion of the first housing member 31*a* in the housing 31. The fixed scroll member 42 includes a fixed base plate 42*a* having a disc shape, a cylindrical outer peripheral wall 42*b* extending from the outer periphery of the fixed base plate 42*a*, and a fixed spiral wall 42*c* extending from the fixed base plate 42*a* inside the outer peripheral wall 42*b*. The front end of the outer peripheral wall 42*b* of the fixed scroll member 42 contacts the rear surface of the shaft support member 38.

A crankshaft 43 is provided at the rear end of the shaft 35 and is offset from a rotational axis L of the shaft 35. A bush 44 is fixedly fitted onto the crankshaft 43. A movable scroll member 45 is supported by the bush 44 through a bearing 59 so as to rotate relative to the shaft 35 and so as to face the fixed scroll member 42. The movable scroll member 45 includes a movable base plate 45*a* having a disc shape and a movable spiral wall 45*b* extending from the base plate 45*a* toward the fixed scroll member 42.

The fixed spiral wall 42*c* of the fixed scroll member 42 is engaged with the movable spiral wall 45*b* of the movable scroll member 45, and the top end surfaces of the fixed spiral wall 42*c* and the movable spiral wall 45*b* respectively contact the movable base plate 45*a* of the movable scroll member 45 and the fixed base plate 42*a* of the fixed scroll member 42. Thus, operation chambers 46 are defined by the fixed base plate 42*a* and the fixed spiral wall 42*c* of the fixed scroll member 42 as well as the movable base plate 45*a* and the movable spiral wall 45*b* of the movable scroll member 45.

When the compressing and expanding mechanism 33 functions as the compressing mechanism, the operation chamber 46 is moved from the outer peripheral side of the fixed scroll member 42 to the central side of the fixed scroll member 42 while reducing in volume by the orbital movement of the movable scroll member 45 relative to the fixed scroll member 42 based on the rotation of the shaft 35 in a predetermined direction. Thus, the refrigerant gas is compressed in the operation chamber 46. Also, when the compressing and expanding mechanism 33 functions as the expanding mechanism, the operation chamber 46 at the central side of the fixed scroll member 42 is moved to the outer peripheral side of the fixed scroll member 42 while increasing in volume by expansion of the refrigerant gas. Thus, the movable scroll member 45 orbits relative to the fixed scroll member 42, and the shaft 35 rotates in the opposite direction.

In the housing 31, the low pressure chamber 18 is defined between the outer peripheral wall 42*b* of the fixed scroll member 42 and the outer peripheral portion of the movable spiral wall 45*b* of the movable scroll member 45. As described above, when the air-conditioning cycle 10 is performed, the low pressure refrigerant gas is introduced from the evaporator 16 into the low pressure chamber 18 (refer to FIG. 1). The low pressure refrigerant gas introduced in the low pressure chamber 18 is introduced into the operation chamber 46 to be compressed. Also, when the Rankine cycle 20 is performed, the refrigerant gas is discharged from the operation chamber 46 at the outer peripheral side of the fixed scroll member 42 into the low pressure chamber 18 after expanding and being depressurized. Then, the refrigerant gas flows out from the low pressure chamber 18 to the cooler 14 (refer to FIG. 2).

In the housing 31, the high pressure chamber 12 is defined between a back surface 30 of the fixed base plate 42*a* of the fixed scroll member 42 and the second housing member 31*b*. As described above, when the air-conditioning cycle 10 is performed, the high pressure refrigerant gas is discharged from the operation chamber 46 at the central side of the fixed scroll member 42 into the high pressure chamber 12. Then, the refrigerant gas flows out from the high pressure chamber 12 to the cooler 14. Also, when the Rankine cycle 20 is performed, the high pressure refrigerant gas is introduced from the boiler 24 into the high pressure chamber 12.

Referring to FIG. 1, a port 47 extends through the center of the fixed base plate 42*a* of the fixed scroll member 42 and interconnects the operation chamber 46 at the central side of the fixed scroll member 42 and the high pressure chamber 12. A discharge valve 48 serving as a differential pressure regulating valve (a reed valve in the first preferred embodiment) is arranged in the high pressure chamber 12 at a position to face the opening of the port 47. The discharge valve 48 opens and closes the port 47 in accordance with pressure difference between the pressure in the operation chamber 46 acting in a direction to open the port 47 and the pressure in the high pressure chamber 12 acting in a direction to close the port 47. The discharge valve 48 and a retainer 49 for restricting the opening degree of the discharge valve 48 by contacting the discharge valve 48 are supported by an electromagnetic actuator 50 that is attached to the second housing member 31*b*.

The electromagnetic actuator 50 includes a coil 51, a cylindrical main body 52, a cover 53, a plunger (movable core) 54 and a spring 55. The main body 52 accommodates the coil 51 therein. The cover 53 seals the rear end opening of the main body 52 and also functions as a fixed core. The plunger 54 is slidably supported in the main body 52 on a side of the front end opening of the main body 52. The spring 55 is interposed between the cover 53 and the plunger 54 for urging the plunger 54 in a direction to separate the plunger 54 from the cover 53.

A holding hole 56 is formed in the rear end portion of the second housing member 31*b* and interconnects the inside (the high pressure chamber 12) and the outside of the second housing member 31*b*. A step 56*a* is formed in the holding hole 56 on a side of the high pressure chamber 12. The main body 52 of the electromagnetic actuator 50 is press-fitted into the holding hole 56 such that the plunger 54 and the cover 53 are respectively located in the high pressure chamber 12 and on the outside of the fluid machine 11. The electromagnetic actuator 50 is inwardly pushed into the holding hole 56 until the main body 52 contacts the step 56*a*. A seal member 71 is interposed between the second housing member 31*b* (the step 56*a*) and the electromagnetic actuator 50 (the main body 52) for sealing the high pressure chamber 12 from the outside air. The discharge valve 48 and the retainer 49 are fixed above the plunger 54 by a bolt 57 and are cantilevered by the plunger 54.

In the electromagnetic actuator 50, a head 57*a* of the bolt 57 protrudes as a guide protrusion toward the fixed scroll member 42 from the discharge valve 48. In the high pressure chamber 12, a guide recess 58 is formed on the back surface 30 of the fixed base plate 42*a* of the fixed scroll member 42 at a position corresponding to the head 57*a* of the bolt 57 for fitting loosely the head 57*a* therein. Even when the plunger 54 is located at the furthest position from the fixed base plate 42*a* of the fixed scroll member 42, the head 57*a* of the bolt 57 stays fitted loosely in the guide recess 58 (refer to FIG. 2).

Referring to FIG. 1, the electromagnetic actuator 50 is in an OFF state (a de-energized state of the coil 51) as the air-conditioning cycle 10 is performed. When the electromagnetic actuator 50 is in the OFF state, the plunger 54 is moved by the urging force of the spring 55 and becomes close to the fixed base plate 42*a* of the fixed scroll member 42.

In the state, the discharge valve 48 contacts the back surface 30 of the fixed base plate 42*a* of the fixed scroll member 42 and functions as the differential pressure regulating valve (an operation position of the discharge valve 48). Thus, the high pressure refrigerant gas in the operation chamber 46 at the central side of the fixed scroll member 42 is discharged into the high pressure chamber 12 at an appropriate timing by the action of the discharge valve 12. Therefore, the refrigerant gas is prevented from flowing back from the high pressure chamber 12 to the operation chamber 46.

Referring to FIG. 2, the electromagnetic actuator 50 is in an ON state (an energized state of the coil 51) when the Rankine cycle 20 is performed. When the electromagnetic actuator 50 is in the ON state, the plunger 54 is moved against the urging force of the spring 55 by the action of electromagnetic attraction force that is generated between the plunger 54 and the cover 53. Thus, the plunger 54 is located at the furthest position from the fixed base plate 42*a* of the fixed scroll member 42.

In this ON state, the whole of the discharge valve 48 moves away from the fixed base plate 42*a* of the fixed scroll member 42 so that the discharge valve 48 fails to function as the differential pressure regulating valve and the port 47 is regularly opened (a non-operation position of the discharge valve 48). Thus, the high pressure refrigerant gas that flows from the boiler 24 into the high pressure chamber 12 flows into the operation chamber 46 at the central side of the fixed scroll member 42 via the port 47 and expands in the operation chamber 46.

According the first preferred embodiment, the following advantageous effects are obtained.

(1) The discharge valve 48 is movable between the operation position where the discharge valve 48 functions as the differential pressure regulating valve and the non-operation position where the discharge valve 48 fails to function as the differential pressure regulating valve. When the fluid machine 11 functions as the compression device, the discharge valve 48 is positioned at the operation position by the electromagnetic actuator 50. Thus, the refrigerant gas in the operation chamber 46 is discharged into the high pressure chamber 12 at the appropriate timing by the action of the discharge valve 48 serving as the differential pressure regulating valve.

Also, when the fluid machine 11 functions as the expansion device, the discharge valve 48 is positioned at the non-operation position by the electromagnetic actuator 50. Thus, the refrigerant gas in the high pressure chamber 12 is introduced into the operation chamber 46 via the regularly opened port 47 and expands in the operation chamber 46. Consequently, even though the fluid machine 11 of the first preferred embodiment includes the discharge valve 48, the fluid machine 11 functions as the expansion device.

(2) The discharge valve 48 is supported by the plunger 54 of the electromagnetic actuator 50. Namely, the discharge valve 48 is directly and operatively connected to the electromagnetic actuator 50. Thus, it is not necessary to provide an additional structure for movably supporting the discharge valve 48 in the housing 31 independently of the electromagnetic actuator 50, and the moving structure for the discharge valve 48 is simplified.

(3) The discharge valve 48 that is the reed valve has a simpler structure than a poppet valve. Also, it is achieved that the discharge valve 48 is operatively connected to the electromagnetic actuator 50 in a simple structure. That is, the discharge valve 48 is simply bolted to the plunger 54 by the bolt 57 in the first preferred embodiment.

(4) Since the head 57*a* (the guide protrusion) of the bolt 57 is provided at the discharge valve 48, the guide recess 58 is formed on the wall surface (the back surface 30 of the fixed base plate 42*a* of the fixed scroll member 42) that faces the discharge valve 48 in the high pressure chamber 12 for loosely fitting the head 57*a* of the bolt 57 therein. Thus, the movement of the discharge valve 48 between the operation position and the non-operation position is guided by the loosely fitted head 57*a* of the bolt 57 in the guide recess 58. Thus, despite the plunger 54 of the electromagnetic actuator 50, the discharge valve 48 stably moves even by the electromagnetic actuator 50 that is generally prone to rattle. Particularly, when the discharge valve 48 is positioned at the operation position, the discharge valve 48 reliably functions as the differential pressure regulating valve.

(5) The discharge valve 48 is fixed to the plunger 54 of the electromagnetic actuator 50 by the bolt 57. The head 57*a* of the bolt 57 serves as the guide protrusion for guiding the movement of the discharge valve 48. Thus, a structure for guiding the movement of the discharge valve 48 is simplified.

Figure 3:
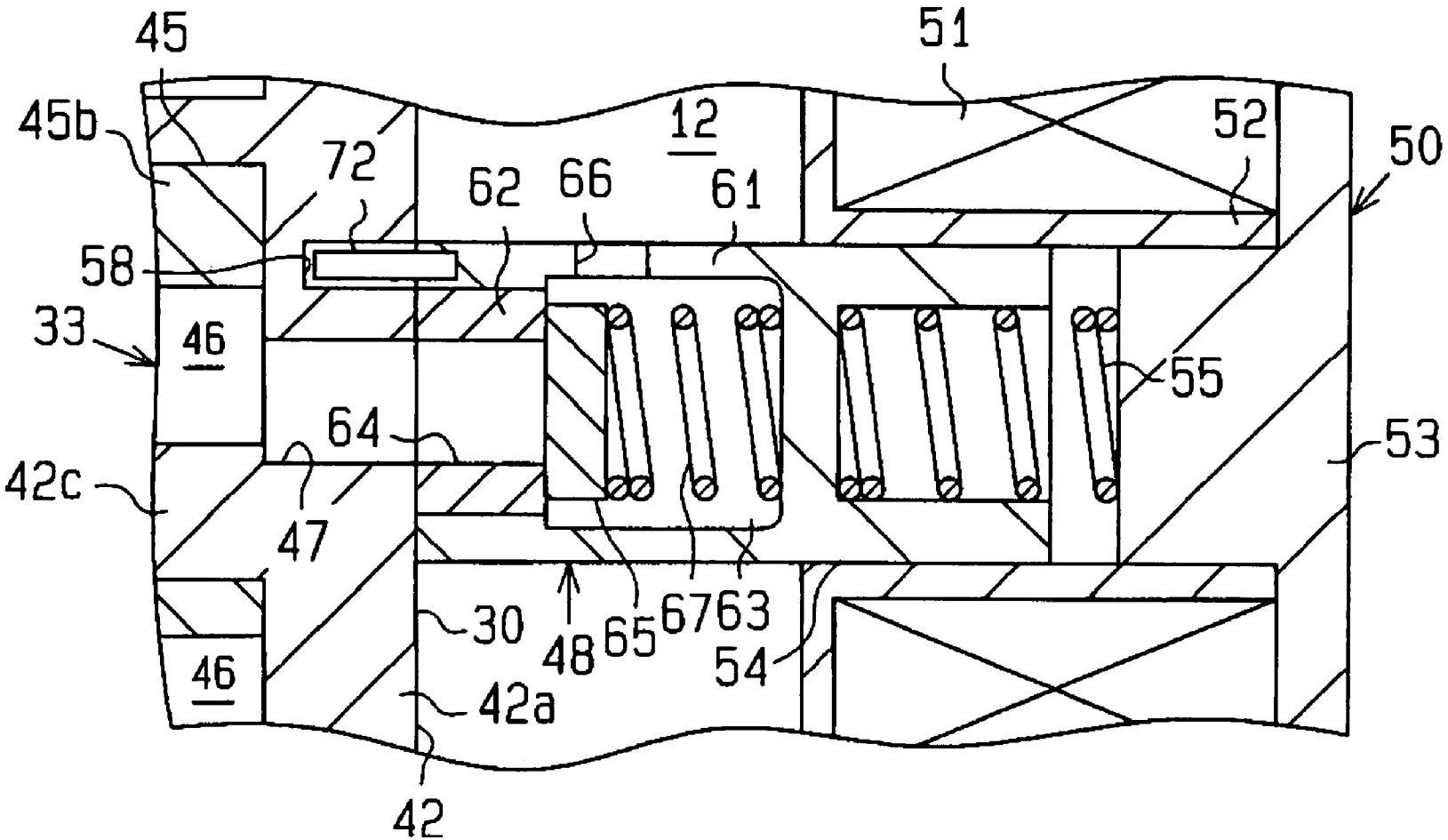
FIG. 3 is a partially enlarged cross-sectional view of a fluid machine served as an expansion device and a compression device upon functioning as the compression device according to a second preferred embodiment of the present invention.
Figure 4:
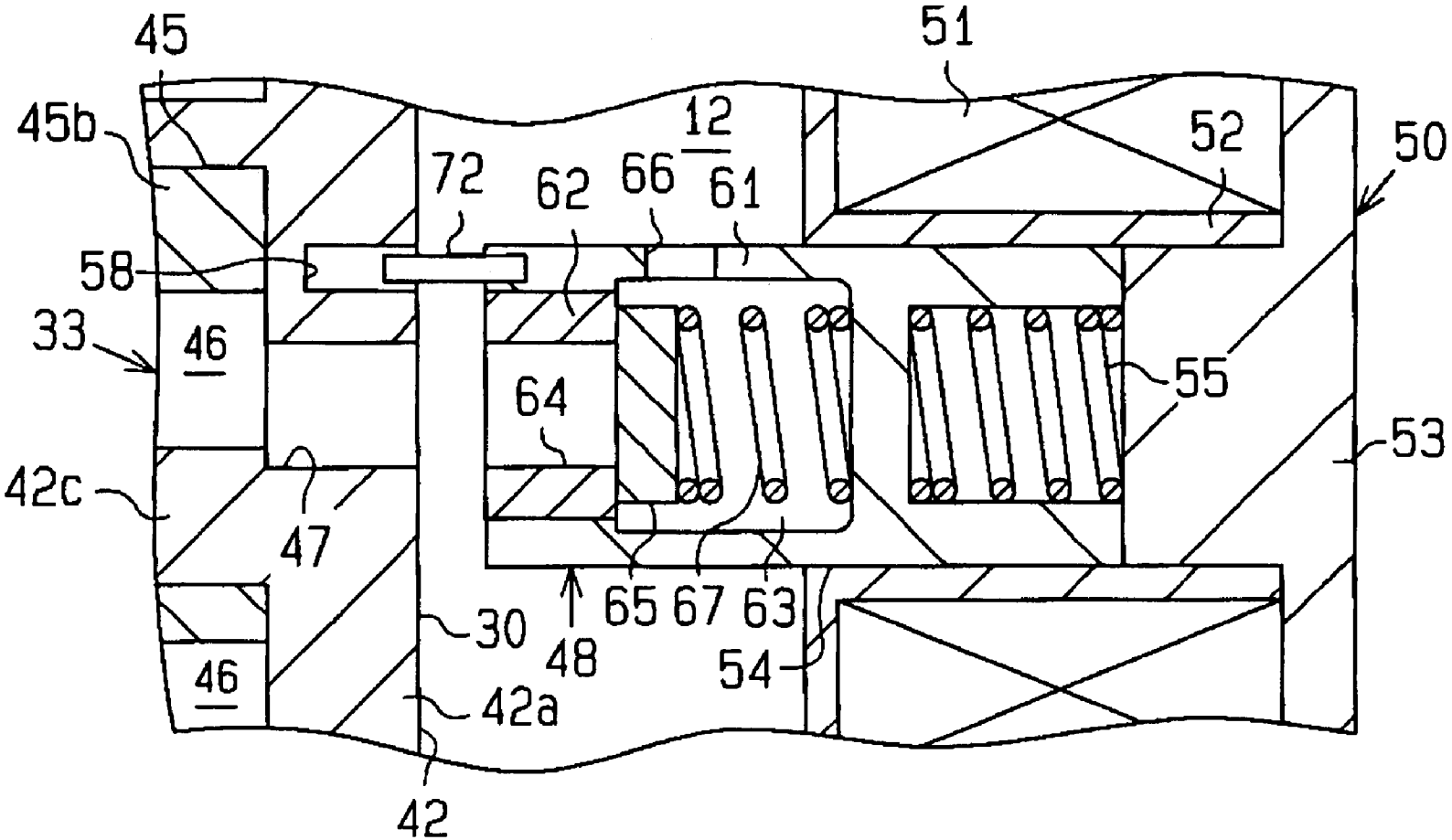
FIG. 4 is a partially enlarged cross-sectional view of the fluid machine upon functioning as the expansion device according to the second preferred embodiment of the present invention.

A second preferred embodiment will be described with reference to FIGS. 3 and 4 now. In the following description about the second preferred embodiment, only the difference thereof from the first preferred embodiment will be described. Similar or corresponding elements or parts are referred to by the same reference numerals, and the detailed description thereof is omitted. As shown in FIGS. 3 and 4, the second preferred embodiment differs from the first preferred embodiment in utilizing a poppet valve as the discharge valve 48.

An accommodating portion 61 is provided at the top end portion of the plunger 54. The accommodating portion 61 has a cylindrical shape with a bottom at one end and is opened at the other end to a side of the fixed scroll member 42. The opening of accommodating portion 61 is closed by a cover 62, thereby defining an accommodating chamber 63 in the accommodating portion 61. In the plunger 54, a guide protrusion 72 is provided at the top end surface of the accommodating portion 61 and functions similarly as the head 57*a* of the bolt 57 of the first preferred embodiment.

A valve hole 64 extends through the cover 62 in a direction from the accommodating chamber 63 toward the fixed scroll member 42 at the position to face the port 47. A poppet 65 is accommodated in the accommodating chamber 63 and movable to open and close the valve hole 64. A communication hole 66 extends through the side wall of the accommodating portion 61 and regularly interconnects the accommodating chamber 63 and the high pressure chamber 12. A spring 67 is arranged in the accommodating chamber 63 for urging the poppet 65 in a direction to close the valve hole 64.

Referring to FIG. 3, when the air-conditioning cycle 10 is performed, the electric actuator 50 is in the OFF state, the plunger 54 is moved by the urging force of the spling 55, and the top end surface of the plunger 54 contacts the back surface 30 of the fixed base plate 42*a* of the fixed scroll member 42 (the operation position of the discharge valve 48). Thus, the port 47 is connected to the valve hole 64 of the cover 62 and communicates with the high pressure chamber 12 only via the inside of the discharge valve 48, that is, the valve hole 64, the accommodating chamber 63 and the communication hole 66. Thus, the discharge valve 48 (the poppet 65) functions as the differential pressure regulating valve for opening and closing the port 47 in accordance with the pressure difference between the pressure in the operation chamber 46 acting in the direction to open the valve hole 64 and the pressure in the high pressure chamber 12 (the accommodating chamber 63) acting in the direction to close the valve hole 64. Consequently, the high pressure refrigerant gas in the operation chamber 46 at the central side of the fixed scroll member 42 is discharged from the port 47 into the high pressure chamber 12 via the valve hole 64, the accommodating chamber 63 and the communication hole 66 at an appropriate timing.

Referring to FIG. 4, when the Rankine cycle 20 is performed, the electromagnetic actuator 50 is in the ON state. Thus, the plunger 54 is moved by the action of the electromagnetic attraction force, and the top end surface of the plunger 54 is separated from the back surface 30 of the fixed base plate 42*a* of the fixed scroll member 42. In this ON state, the cover 62 of the discharge valve 48 is separated from the back surface 30 of the fixed base plate 42*a* of the fixed scroll member 42 (the non-operation position of the discharge valve 48). Thus, the valve hole 64 and the port 47 are not connected, and the port 47 directly communicates with high pressure chamber 12. Therefore, the discharge valve 48 does not function as the differential pressure regulating valve, and the port 47 is regularly opened.

According to the second preferred embodiment, the same advantageous effects are obtained as mentioned in the paragraphs (1), (2) and (4) in the first preferred embodiment.

The following alternative embodiments may be practiced according to the present invention.

Figure 5:
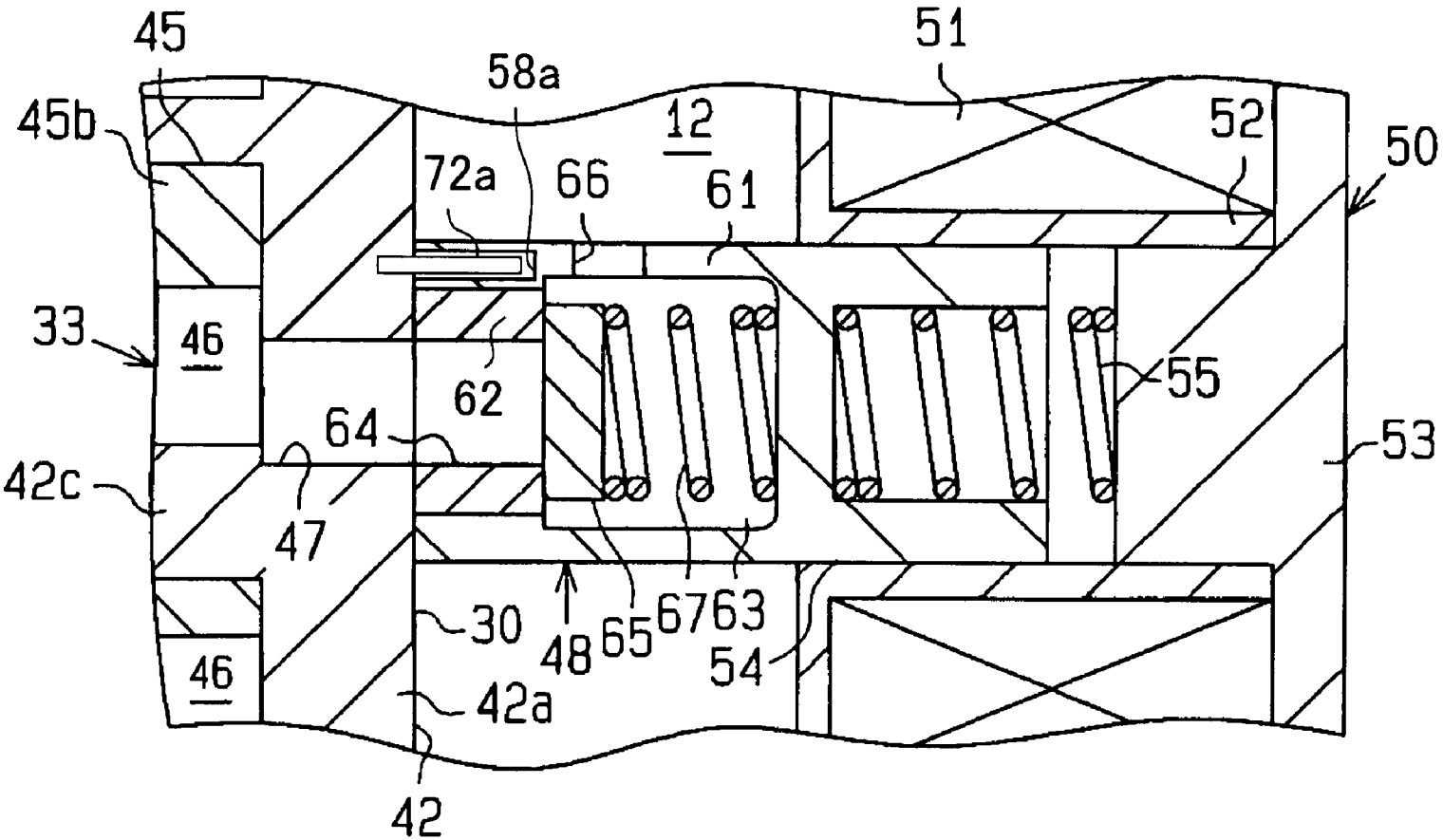
FIG. 5 is a partially enlarged cross-sectional view of a fluid machine served as an expansion device and a compression device upon functioning as the compression machine according to an alternative embodiment of the present invention.

In the above-described preferred embodiments, the guide protrusion (the head 57*a* of the bolt 57, the guide protrusion 72) is provided at the discharge valve 48, and the guide recess 58 is formed on the back surface 30 of the fixed base plate 42*a* of the fixed scroll member 42. However, in an alternative preferred embodiment, the guide recess 58 is provided at the discharge valve 48, and the guide protrusion is provided at the back surface 30 of the fixed base plate 42*a* of the fixed scroll member 42. As shown in FIG. 5, for example, a guide recess 58*a* is formed on the top end surface of the accommodating portion 61, and a guide protrusion 72*a* is provided at the back surface 30 of the fixed base plate 42*a* of the fixed scroll member 42.

In the above-described preferred embodiments, the electromagnetic actuator 50 is utilized as an actuator. However, a fluid pressure actuator such as a hydraulic actuator is utilized as the actuator in an altetnative preferred embodiment.

In the above-described preferred embodiments, the compressing and expanding mechanism 33 is the scroll type mechanism. However, the compressing and expanding mechanism 33 is changed into other type mechanisms such as vane type and piston type in an alternative preferred embodiment.

In the above-described preferred embodiments, when the fluid machine 11 functions as the compression device, the compressing and expanding mechanism 33 is selectively driven by the engine E and the electric motor (the motor generator 32). However, the motor generator 32 is changed into a mere generator. Thus, the compressing and expanding mechanism 33 is driven only by the engine E. Alternatively, the power transmission mechanism PT is removed in the above-described preferred embodiment. Thus, the compressing and expanding mechanism 33 is driven only by the electric motor (the motor generator 32).

In the above-described preferred embodiments, the boiler 24 is constructed such that the refrigerant is heated by the cooling water of the engine E. However, in an alternative embodiment, the boiler 24 is constructed such that the refrigerant is heated by the exhaust gas of the engine E as a heat source. Alternatively, the boiler 24 is constructed such that the refrigerant is heated by lubricating oil of the engine E as the heat source.

In an electric vehicle that is driven only by an electric motor, the fluid machine 11 performs the air-conditioning cycle and the Rankine cycle. In this case, the boiler 24 is constructed such that the refrigerant is heated by the cooling water that collects the exhaust heat of the electric motor and the exhaust heat of a control circuit (inverter) that controls the electric motor.

The fluid machine 11 of the present invention is performs the air-conditioning cycle and the Rankine cycle that are not provided in the vehicle.

The present examples and embodiments are to be considered as illustrative and not restrictive, and the invention is not to be limited to the details given herein but may be modified within the scope of the appended claims.

What is claimed is:

1. A fluid machine served as an expansion device and a compression device, the fluid machine introducing gas from a low pressure chamber into an operation chamber and compressing the gas in the operation chamber and discharging the gas into a high pressure chamber via a port when the fluid machine functions as the compression device, the fluid machine introducing the gas from the high pressure chamber into the operation chamber via the port and expanding the gas in the operation chamber and discharging the gas into the low pressure chamber when the fluid machine functions as the expansion device, comprising:

a discharge valve serving as a differential pressure regulating valve for opening and closing the port in accordance with pressure difference between a pressure in the operation chamber and a pressure in the high pressure chamber, the discharge valve being movable between an operation position where the discharge valve functions as the differential pressure regulating valve and a non-operation position where the discharge valve fails to function as the differential pressure regulating valve and constantly opens the port; and an actuator operatively connected to the discharge valve for moving the discharge valve between the operation position and the non-operation position, the actuator positioning the discharge valve at the operation position when the fluid machine functions as the compression device, the actuator positioning the discharge valve at the non-operation position when the fluid machine functions as the expansion device.

2. The fluid machine according to claim 1, wherein the actuator is an electromagnetic actuator including a plunger by which the discharge valve is supported.

3. The fluid machine according to claim 2, wherein a guide protrusion is provided at the discharge valve, a guide recess is formed on a wall surface that faces the guide protrusion in the high pressure chamber for fining loosely the guide protrusion therein, wherein the movement of the discharge valve is guided by fitting the guide protrusion in the guide recess.

4. The fluid machine according to claim 3, wherein the discharge valve is a reed valve, the discharge valve being fixed to a top end of the plunger of the electromagnetic actuator by a bolt having a head that serves as the guide protrusion.

5. The fluid machine according to claim 3, wherein the discharge valve is a poppet valve.

6. The fluid machine according to claim 2, wherein a guide recess is provided at the discharge valve, a guide protrusion is provided at a wall surface that faces the guide recess in the high pressure chamber for fitting loosely in the guide recess, wherein the movement of the discharge valve is guided by fitting the guide protrusion in the guide recess.

7. The fluid machine according to claim 6, wherein the discharge valve is a poppet valve.

8. The fluid machine according to claim 1, wherein the fluid machine is a scroll type.

9. The fluid machine according to claim 1, wherein the fluid machine performs an air-conditioning cycle and a Rankine cycle.

* * * * *